United States Patent [19]

Weinreich

[11] Patent Number: 4,753,478

[45] Date of Patent: Jun. 28, 1988

[54] BACK SUPPORT AND MOUNTING METHOD

[76] Inventor: Avron I. Weinreich, 17517 Tramonto Dr., Pacific Palisades, Calif. 90272

[21] Appl. No.: 942,835

[22] Filed: Dec. 17, 1986

[51] Int. Cl.[4] ..... A47C 3/00

[52] U.S. Cl. ..... 297/284; 297/4

[58] Field of Search ..... 297/284, 230, 231, 460, 297/393, 397, 4; 5/432

[56] References Cited

U.S. PATENT DOCUMENTS

| | | | |
|---|---|---|---|
| 1,667,626 | 4/1928 | Epstein | 297/460 |
| 2,591,306 | 4/1952 | Sherman | 297/397 |
| 2,812,804 | 11/1957 | Sandor . | |
| 2,822,033 | 2/1958 | Dixon | 297/284 X |
| 2,973,030 | 2/1961 | Matthewson | 297/393 |
| 3,185,362 | 5/1965 | Wakefield | 297/4 X |
| 3,279,849 | 10/1966 | Radke et al. | 297/284 |
| 4,025,105 | 5/1977 | Pekaca | 297/4 |
| 4,095,842 | 6/1978 | Tretick | 297/4 |
| 4,097,087 | 6/1978 | Garavaglia | 297/284 |
| 4,157,839 | 6/1979 | Lahti et al. | 297/230 X |
| 4,471,993 | 9/1984 | Watson . | |
| 4,512,047 | 4/1985 | Johnson | 5/432 |
| 4,541,670 | 9/1985 | Morgenstern et al. | 297/284 |

FOREIGN PATENT DOCUMENTS

| | | | |
|---|---|---|---|
| 1296761 | 6/1969 | Fed. Rep. of Germany | 297/284 |
| 2340196 | 2/1974 | Fed. Rep. of Germany | 297/284 |
| 429447 | 5/1976 | Fed. Rep. of Germany | 297/393 |
| 1163117 | 9/1969 | United Kingdom | 297/230 |
| 2047088 | 11/1980 | United Kingdom | 297/284 |

*Primary Examiner*—Kenneth J. Dorner
*Assistant Examiner*—José V. Chen
*Attorney, Agent, or Firm*—Macdonald, Halsted & Laybourne

[57] ABSTRACT

A lower back support comprising two elongated cylindrical tubular members composed of polyurethane foam and held in side-by-side relation in proper position against a user's back by an elongated flexible strap support which permits a limited rolling action of the members against the back. The strap extends loosely through one member, and then loosely through the other from opposite ends, then forming a loop of adjustable size passing under the user's arms and around the back of the neck. VELCRO-type fabric strips on the strap form a connection of adjustable length.

5 Claims, 1 Drawing Sheet

BACK SUPPORT AND MOUNTING METHOD

BACKGROUND OF THE INVENTION

This invention relates to back supports, and relates more specifically to a lumbar support and a method of positioning the support across the lower back between the latter and the back of a seat.

Lower back pain is a common and widespread problem among adults, and its prevention and treatment are significant medical problems. One important cause of such pain is poor posture, particularly slouching in the sitting position in poorly designed furniture, including seats in automobiles, airplanes and theaters.

To reduce or prevent the occurrence of lower back pain, numerous lower back supports have been proposed and used. Among these are a personalized lower back cushion disclosed in U.S. Pat. No. 4,471,993, which is shaped to fit the contour of a user's lower back and can be strapped to the back of a chair or other seat, and an adjustable back support disclosed in U.S. Pat. No. 4,097,087 with a lumbar support cushion that is selectively adjustable on the back of a chair. Other prior devices are identified in these patents.

At the opposite end of the range of complexity are simpler cushion supports, including the adjustable cushions of U.S. Pat. Nos. 2,591,306 and 1,667,626, both having means for supporting the cushions in place on a seat back, and the rack-like adjustable back rest of U.S. Pat. No. 2,812,804. The extreme of simplicity is a folded towel that can be placed between the small of the back and a seat back as an expedient.

Despite these and other proposed approaches for lower back support, the problem remains unsolved. The present invention provides a simplified and improved support, particularly well adapted for use by the traveller in an automobile, an airplane or the like.

SUMMARY OF THE INVENTION

The present invention resides in a novel back support that is of simple and relatively inexpensive construction and is both effective and convenient to use, particularly for travellers. To these ends, the back support of this invention comprises an elongated resiliently compressible cushion sized to extend across the lower back between the latter and a seat back, and an elongated flexible support extending from the opposite ends of the cushion and forming a loop for passing under the user's arms and around the back of the neck. The support has an adjustable connection, preferably a hook-and-loop (e.g., the type sold under the trademark VELCRO) coupling on overlapping ends of two sections of the support disposed behind the neck, for ease of positioning the back support properly on the user's back. The method of the invention resides in the steps of providing such a cushion and support, and applying it to the user in the foregoing manner.

More specifically, the preferred embodiment of the present invention comprises a cushion in the form of one or more tubular cushion members composed of resiliently compressible material such as polyurethane foam, with a support in the form of a flexible strap having two sections extending from opposite ends of the cushion with VELCRO-type fasteners on overlapping opposite end portions of the strap sections. For enhanced effectiveness, at least two such tubular cushion members are disposed in an adjacent and generally parallel relation, to provide substantial width for the support without sacrificing simplicity of construction, and also to provide a rolling effect which is believed to be beneficial to the back, as a form of gentle massage. Two such cushion members on the order of two inches in outside diameter and approximately twelve inches in length constitute the presently preferred embodiment of the invention, and the preferred strap support extends through the lower cushion member, then through the second member from both ends, and then upwardly from each end to form an adjustable supporting loop for passing around the user's neck. The loop also may be used to hand the support from a head rest in proper position on an automobile seat.

Other aspects and advantages of the invention will become apparent from the following detailed description, taken in conjunction with the accompanying drawings.

DETAILED DESCRIPTION OF THE PREFERRED EMBODIMENT

Figure 4:
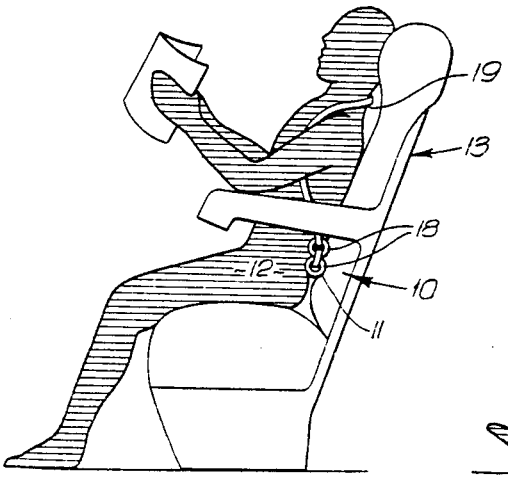
FIG. 4 is a schematic view showing a user wearing the back support in an illustrative airplane seat.
Figure 5:
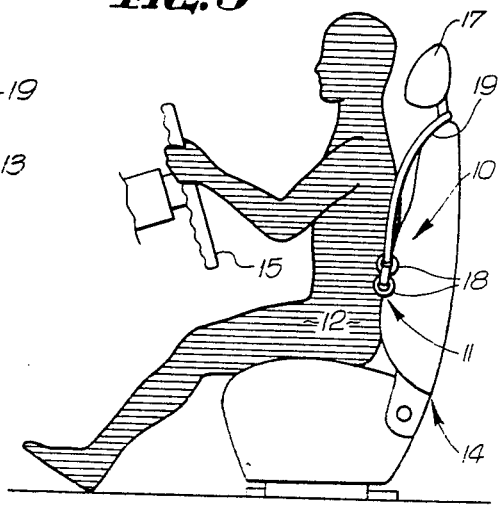
FIG. 5 is a schematic view showing a user in an automobile driver's seat with the back support hanging from a headrest on the seat.

As shown in the drawings for purposes of illustration, the invention is embodied in a back support, indicated generally by the reference number 10 in the drawings, including a cushion 11 for fitting against the back of a user, indicated by the reference number 12, in the concavely curved lower portion of the back to provide so-called lumbar support between the user's back and the back of a seat. Illustrative seats are shown in FIGS. 4 and 5, as a standard airplane seat 13 in FIG. 4 and the driver's seat 14 of an automobile in FIG. 5, the automobile seat 14 being positioned behind a steering wheel 15 and having a conventional headrest 17 on the upper end of the seat back.

The cushion 11 of the improved back support comprises one or more, and preferably at least two, elongated tubular cushion members 18 that are composed of relatively firm, resiliently compressible cushion material so as to provide comfortable support for the lower back. The cushion is sized to fill the space between the concavely curved lower back and the back of the seat in which the user is sitting, and to extend substantially entirely across the back of the user so that the opposite ends of the cushion lie along opposite sides of the user's back.

In the presently preferred embodiment, two tubular cushion members 18 are used, and each is composed of polyurethane foam and is on the order of two inches in outside diameter and twelve inches in length. Such material is commerically available in extruded form, with a wall thickness on the order of one-half inch to three-fourths inch, and has been found to be quite suitable for use in the invention.

The back support 10 has an adjustable support 19 for positioning the cushion properly on the user's back.

This support herein comprises an elongated flexible strap of suitable material such as nylon, having two sections 19[a] and 19[b] extending from opposite ends of the cushion and long enough to extend under both arms of the user and around the back of the user's neck. Adjustability and ease of positioning are provided by providing adjustable connectors 20 herein lengths of VELCRO-type interlocking fasteners, on overlapping end portions on the two strap sections. For convenience, the strap can be installed so that the fasteners lie behind the user's neck.

Figure 1:
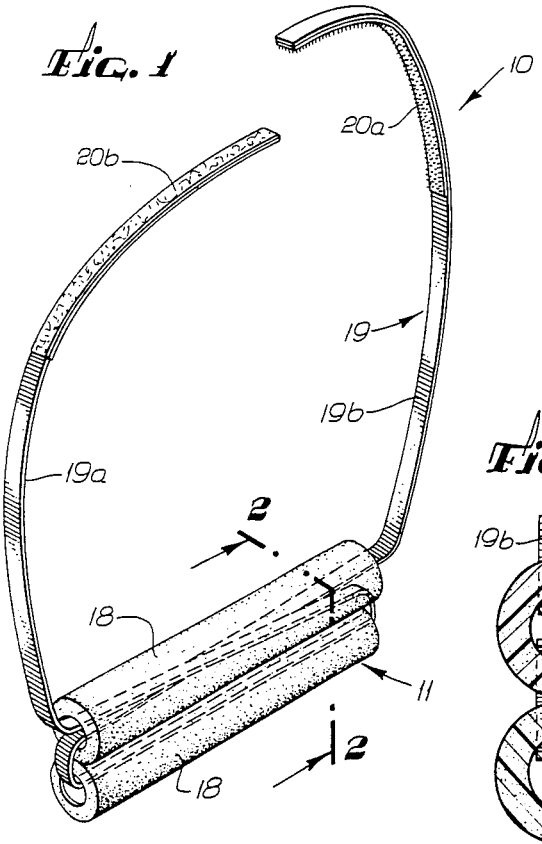
FIG. 1 is a perspective view of a back support embodying the novel features of the present invention.

A single length of such a strap can be used both to join the two cushion members 18 together and to form the support 19. For this purpose, the strap is made approximately six feet in length, and is passed first through the lower cushion member, and then from opposite ends through the second cushion member, so that the opposite end portions of the strap extend out of the upper member and form an openable loop, as shown in FIG. 1.

Two lengths of interlocking VELCRO-type fabric are applied to adjacent sides of the opposite end portions of the strap, with the usual "hook" type fabric 20[a] on one end portion and the "loop" type 20[b] on the other end portion. By varying the amount of overlap, the effective length of the support is easily adjusted to position the cushion properly on the lower back.

It should be noted that the cylindrical configuration of the cushion members 18 and their strap mounting arrangement permits limited relative rotation of the members, so they can roll against the back as the user moves relative to the seat back. This provides a gentle massaging action that is believed to be beneficial to the back. The relative firmness of the polyurethane foam material contributes to this action.

Figure 3:
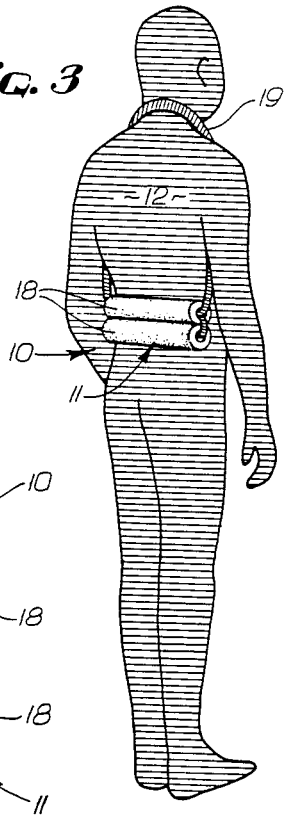
FIG. 3 is a schematic view from the rear of a standing user wearing the back support of the invention.
Figure 2:
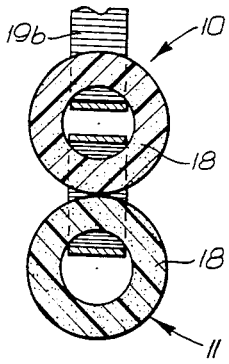
FIG. 2 is an enlarged fragmentary crosssectional view taken along line 2—2 of FIG. 1.

The back support is most conveniently applied while the user is standing, as shown in FIG. 3, to remain in place when the user sits, as shown in FIG. 4. In accordance with the method of the invention, the support straps are extended under the arms and around the neck and are joined together to make the support of the proper length to hold the cushion properly on the back. The support then will remain comfortably in place when the user rises and walks around, and will be in place when the user again sits down. It is lightweight and unobtrusive, and thus is very comfortable to wear. In fact, a traveller can conveniently leave the support in place throughout the trip, even while boarding, deplaning and travelling by taxi or other public conveyance.

For automobile use, the support can be worn in the usual fashion or, alternatively, removed and suspended from the usual headrest 17 on the seat back, as shown in FIG. 5. The effective length of the support can be adjusted to adapt it to the height of the particular seat back.

The specific dimensions that are given in this description are to be taken as illusrative only, and different sizes of cushions and supports may be provided for use by users who are not of average size. More than two cushion members may be used where it is desired to provide engagement with a longer portion of the back, and members of greater diameter may be used where it is desired to form a thicker cushion. It is believed, however, that the illustrative dimensions will provide a generally satisfactory back support.

From the foregoing, it will be seen that the present invention provides a novel back support that is relatively simple and inexpensive in construction, supported in a novel and comfortable manner on the user, and capable of providing effective lower back or lumbar support with a gentle rolling motion against the back. It also will be apparent that, while one specific embodiment has been illustrated and described in detail, various modifications and changes may be made without departing from the spirit and scope of the invention.

I claim as my invention:

1. A back support for fitting against the lower back of a user to support the lower back when the user sits in a seat having a seat back, said back support comprising:

at least two elongated, generally cylindrical tubular cushion members disposed in an adjacent and generally parallel relation and sized to extend across the lower back of the user to provide lumbar support, each of said cushion members being composed of relatively firm, resiliently compressible material and having an outside diameter of approximately two inches and a length of approximately twelve inches;

an elongated flexible support strap holding said cushion members together and in position against the lower back, said strap extending through one of said members and out through the ends thereof, then through the other member and out through both ends, and then forming a loop of sufficient length to pass beneath the arms of the user and around the back of the user's neck, said strap having overlapping free end portions;

and hook-and-loop type fasteners on said overlapping free end portions for securing the latter together.

2. A back support as defined in claim 1 wherein said strap passes loosely through at least one of said cushion members to support the latter for limited relative rotation for a rolling massage action.

3. A back support for fitting against the lower back of a user to support the lower back when the user sits in a seat having a seat back, said back support comprising:

an elongated, resiliently compressible cushion sized to extend across the lower back of the user between the lower back and the seat back and to provide lumbar support, said cushion having opposite ends for lying along opposite sides of the lower back;

an elongated, flexible support secured at opposite ends to the ends of said cushion, said flexible support being sized to extend to one end of said cushion, when the latter is in position against the lower back, upwardly under one arm of the user, over the user's shoulder and around the user's neck, and then over the other shoulder and under the other arm, back to the other end of said cushion;

and means for adjusting the length of said flexible support to position said cushion vertically along the user's back;

wherein said cushion comprises two tubular members of approximately the same length and diameter disposed in an adjacent and generally parallel relation, said tubular members being composed of polyurethane foam; and wherein said support comprises an elongated flexible strap having free ends to be disposed behind the neck of the user and having two lengths of interlocking hook-and-loop type fabric adjacent its ends, said strap extending loosely through one of said tubular cushion members and outer of both ends thereof, then extending loosely through the other tubular cushion member from each end thereof, and then extending away from said other tubular cushion member to form a loop when said interlocking fabric is engaged.

4. A back support for fitting against the lower back of a user to support the lower back when the user sits in a seat having a seat back, said back support comprising:

an elongated, resiliently compressible cushion sized to extend across the lower back of the user between the lower back and the seat back and to provide lumbar support, said cushion having opposite ends for lying along opposite sides of the lower back;

an elongated, flexible support secured at opposite ends to the ends of said cushion, said flexible support being sized to extend to one end of said cushion, when the latter is in position against the lower back, upwardly under one arm of the user, over the user's shoulder and around the user's neck, and then over the other shoulder and under the other arm, back to the other end of said cushion;

and means for adjusting the length of said flexible support to position said cushion vertically along the user's back;

wherein said cushion comprises two generally cylindrical tubular members disposed in an adjacent and generally parallel relation, and further including means securing said tubular members to said flexible support and supporting said members for relative rotation.

5. The method of providing support between the lower back of a user and the back of a seat, comprising the steps of:

providing an elongated resiliently compressible cushion sized to extend across the lower back of the user and to brace the same in front of the seat back to provide lumbar support, and having opposite ends for lying adjacent opposite sides of the lower back;

securing an elongated flexible support to said cushion adjacent opposite ends thereof;

extending said flexible support upwardly under the arms of the user, over the user's shoulder and around the rear side of the user's neck;

sizing said flexible support to position said cushion properly across the lower back to provide lumbar support while the user is sitting in the seat; and including the further steps of forming said support of two elongated generally cylindrical cushion members, disposing said cushion members in an adjacent and generally parallel relation and supporting the members on said flexible support for limited relative rotation against the user's back.

* * * * *